US007765970B2

(12) United States Patent
Sammons

(10) Patent No.: US 7,765,970 B2
(45) Date of Patent: Aug. 3, 2010

(54) VALVE COVER WITH A DISPLAY WINDOW

(76) Inventor: James Roland Sammons, 2645 W. Allen, Springfield, MO (US) 65810

( * ) Notice: Subject to any disclaimer, the term of this patent is extended or adjusted under 35 U.S.C. 154(b) by 327 days.

(21) Appl. No.: 11/756,692

(22) Filed: Jun. 1, 2007

(65) Prior Publication Data

US 2007/0277724 A1 Dec. 6, 2007

Related U.S. Application Data

(60) Provisional application No. 60/810,058, filed on Jun. 1, 2006.

(51) Int. Cl.
*F01M 9/10* (2006.01)

(52) U.S. Cl. ..... 123/90.38; 123/195 C; 123/198 E

(58) Field of Classification Search ..... 123/90.38, 123/90.37, 195 C, 198 E
See application file for complete search history.

(56) References Cited

U.S. PATENT DOCUMENTS 4,483,278 A * 11/1984 Kolacz ..... 123/41.33

2005/0228557 A1* 10/2005 Swan ..... 701/30

* cited by examiner

*Primary Examiner*—Zelalem Eshete
(74) *Attorney, Agent, or Firm*—Martin & Associates, LLC; Derek P. Martin

(57) ABSTRACT

A valve cover includes a base that attaches to an engine and a display window that attaches to the base. The display window is made of material that can withstand the operating environment of the engine, including temperature and resistance to petroleum-based substances. The display window is secured to the base using a flexible gasket that encircles the display window and snaps into a groove in the base to secure the display window to the base. The display window may be see-through so the valves are visible. The display window may also include one or more display elements, such as light-emitting diodes, optical fibers, electro-luminescent panels, incandescent bulbs, liquid crystal displays, etc. The display window may include embossed or etched portions, and may include multiple colors and sequenced operation to provide any desired effect on the display panel.

13 Claims, 6 Drawing Sheets

VALVE COVER WITH A DISPLAY WINDOW

BACKGROUND

1. Technical Field

This disclosure generally relates to internal combustion engines, and more specifically relates to a valve cover for an internal combustion engine.

2. Background Art

See-through valve covers are known in the art to show valves of an internal combustion engine when the engine is not running. These see-through valve covers are typically made of a transparent plastic material, such as plexiglass, which allows seeing through the cover. The materials for known see-through valve covers cannot withstand the operating temperatures of an internal combustion engine. As a result, the known see-through valve covers are made for use only when the engine is not running.

Many car enthusiasts enjoy displaying their cars at car shows. One aspect of showing a car is the appearance of the engine under the hood. When a hood is raised for public inspection of the engine compartment, the car owner wants to present a clean and attractive appearance so the car shows well. One way to provide a different and attractive appearance of the engine compartment is to use see-through valve covers. However, because the known see-through valve covers cannot survive operating temperature of an engine, the only way a car can be shown with known see-through valve covers is to put them on the car, then not run the engine after they are installed. This causes great inconvenience because even when a car is transported to and from a car show on a trailer, the engine is typically run to drive the car off the trailer and to drive the car back on the trailer. If the car is driven to the car show, a person would have to drive to the show with normal metal valve covers, then remove the metal valve covers and replace them with the known see-through valve covers for the show. Once the show concludes, the person would then have to remove the see-through valve covers and replace them with the metal valve covers to drive the car home. Needless to say, swapping between see-through valve covers for show and metal valve covers when the engine needs to be run is very inconvenient. What is needed is a valve cover that shows well and that also withstands the operating environment of an engine.

BRIEF SUMMARY

A valve cover includes a base that attaches to an engine and a display window that attaches to the base. The display window is made of material that can withstand the operating environment of the engine, including temperature and resistance to petroleum-based substances. The display window is secured to the base using a flexible gasket that encircles the display window and snaps into a groove in the base to secure the display window to the base. The display window may be see-through so the valves are visible. The display window may also include one or more display elements, such as light-emitting diodes (LEDs), optical fibers, electro-luminescent (EL) panels, incandescent bulbs, liquid crystal displays (LCDs), etc. Suitable display drivers provide a desired display on the display window. The display window may include embossed or etched portions, and may include multiple colors. In addition, the display drivers may provide sequenced operation to provide any desired effect on the display panel. The result is a valve cover with a display panel that can withstand operating conditions of the engine and provides a very attractive appearance.

The foregoing and other features and advantages will be apparent from the following more particular description, as illustrated in the accompanying drawings.

BRIEF DESCRIPTION OF THE SEVERAL VIEWS OF THE DRAWING(S)

The disclosure will be described in conjunction with the appended drawings, where like designations denote like elements, and:

DETAILED DESCRIPTION

A valve cover includes a base that attaches to an engine and a display window that attaches to the base. The display window is made of material that can withstand the operating environment of the engine, including temperature and resistance to petroleum-based substances. The display window is secured to the base using a flexible gasket that encircles the display window and snaps into a groove in the base to secure the display window to the base. The display window may be see-through so the valves are visible. The display window may also include one or more display elements, such as light-emitting diodes (LEDs), optical fibers, electro-luminescent (EL) panels, incandescent bulbs, liquid crystal displays (LCDs), etc. The display window may include embossed or etched portions, and may include multiple colors and sequenced operation to provide any desired effect on the display panel.

Figure 1:
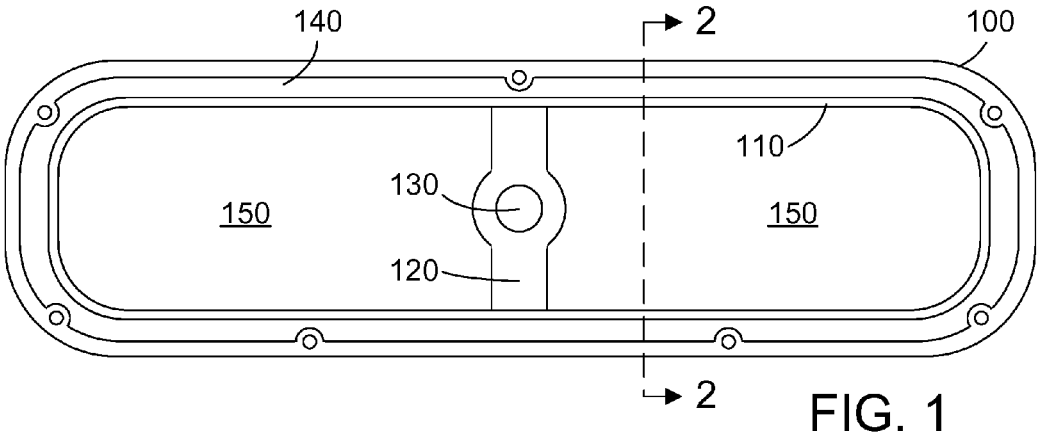
FIG. 1 is a top view of a base portion of a valve cover that may be fitted with a display window.
Figure 2:
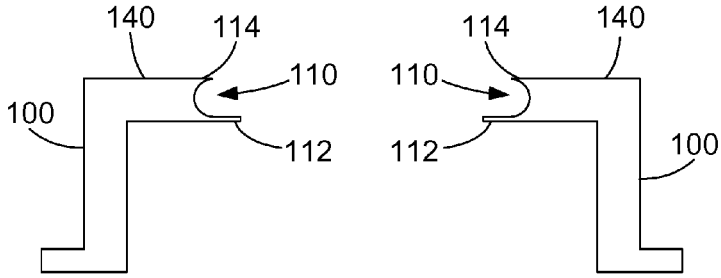
FIG. 2 is a partial cross-sectional view of the valve cover in FIG. 1 taken along the line 2-2.

Referring to FIGS. 1 and 2, a base portion 100 for a valve cover includes an opening 150 in a top 140 of the base portion 100. Base portion 100 is preferably metal, but could be any suitable material that can withstand the temperatures of an internal combustion engine and the exposure to motor oil and other petroleum-based substances. A cross member 120 includes a hole 130. The edges of opening 150 define a groove 110 extending along an interior perimeter of the opening 150, as shown in partial cross-section in FIG. 2. Note FIG. 2 is a partial cross-section because only the sides of base portion 100 are shown to clearly illustrate the configuration of the groove 110. In the most preferred implementation, groove 110 includes a substantially semi-circular cross section with the bottom portion 112 longer than the top portion 114. This configuration allows a flexible gasket surrounding a display window to be snapped into place past top portion 114 while minimizing the risk of the gasket being pushed past the bottom portion 112. Note, however, that any suitable geometric configuration for a gasket may be used, in which case the groove 110 will preferably have a cross-section that matches the geometric configuration of the flexible gasket.

Figure 3:
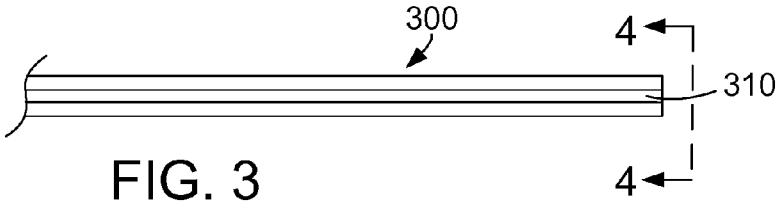
FIG. 3 is a top view of a flexible gasket that may be used to attach a display window to the base portion of the valve cover shown in FIGS. 1 and 2.
Figure 4:
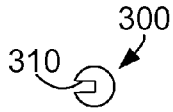
FIG. 4 is an end view of the gasket shown in FIG. 3 taken along the line 4-4.

One suitable implementation for the flexible gasket is shown as 300 in FIGS. 3 and 4. Flexible gasket 300 has a groove 310 along its linear length. In one suitable implementation, gasket 300 is made of extruded rubber, and a suitable length is cut so the two ends butt up to each other, forming a tight seal when the flexible gasket is placed on a display window, such as 500 shown in FIG. 5. In another suitable implementation, gasket 300 is made in a loop of an appropriate size that allows the gasket 300 to be pushed on the outside edge of a display window, such as 500 shown in FIG. 5. Gasket 300 expressly includes any suitable configuration that is capable of obtaining a seal between the display window 500 and the base portion 100, and any suitable material that has sufficient flexibility that allows the gasket 300 to be pressed into groove 110 (FIG. 2) when gasket 300 is attached to a display window 500.

Figure 5:
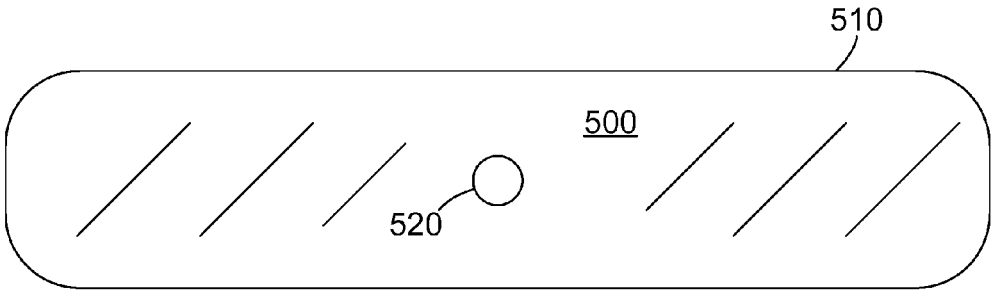
FIG. 5 is a display window that may be attached to the valve cover of FIGS. 1 and 2.

Referring to FIG. 5, display window 500 includes an outer perimeter 510 and a hole 520. The gasket 300 shown in FIGS. 3 and 4 includes a groove 310 that is dimensioned to receive the outer perimeter 510 of the display window 500. The hole 520 in the display window preferably overlies the hole 130 in the cross member 120 shown in FIG. 1 when the display window 500 is snapped into place in the opening 150.

Figure 6:
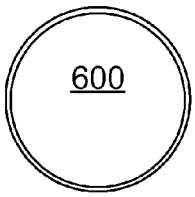
FIG. 6 Prior Art
FIG. 6 is a top view of a prior art valve breather.
Figure 7:
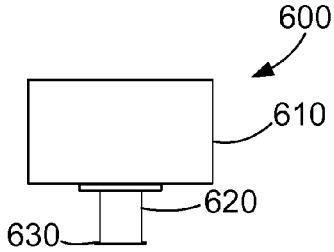
FIG. 7 Prior Art
FIG. 7 is a side view of the prior art valve breather shown in FIG. 6.
Figure 8:
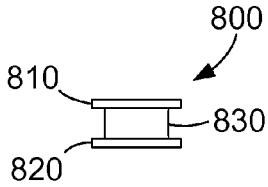
FIG. 8 Prior Art
FIG. 8 is a side view of a prior art flexible grommet used to secure the valve breather in FIG. 6 to a valve cover.

Referring to FIGS. 6 and 7, a breather 600 is a breather that is known in the art for relieving pressure inside a valve cover. Breather 600 includes a cylindrical portion 610 and a stem portion 620 that includes a raised edge 630. FIG. 8 shows a prior art grommet 800 that is used to attach a breather to a prior art metal valve cover. The grommet 800 includes a top lip portion 810, a bottom lip portion 820, and a reduced diameter portion 830. In the prior art, the height of the reduced diameter portion 830 is selected to match the thickness of the top of the valve cover. To install the prior art breather 600 into a prior art metal valve cover, a hole of the appropriate size is drilled in the valve cover. The hole preferably has a diameter slightly smaller than the diameter of the reduced diameter portion 830 to allow a tight fit between the hole and the grommet 800. The grommet 800 is then pushed into the hole in the valve cover, which results in the top lip portion 810 lying atop the top of the valve cover and the bottom lip portion 820 lying underneath the inside of the top of the valve cover. The breather 600 is then put into place by pushing the stem portion 620 with its raised edge 630 through the center of the grommet 800. The raised edge 630 preferably extends below the bottom lip portion 820 when the breather 600 is properly installed, thereby retaining the breather 600 in place.

Figure 9:
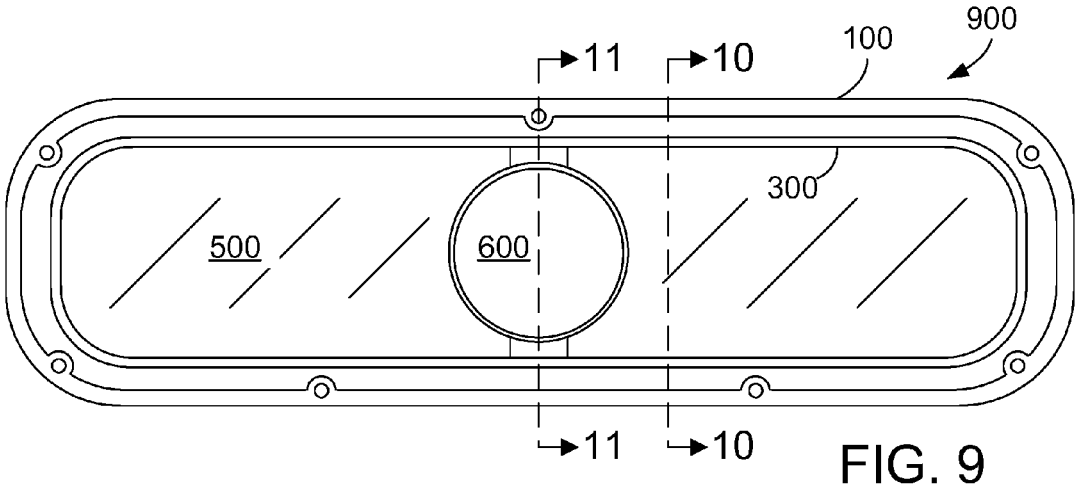
FIG. 9 is a top view of a valve cover assembly that includes an installed display window.
Figure 10:
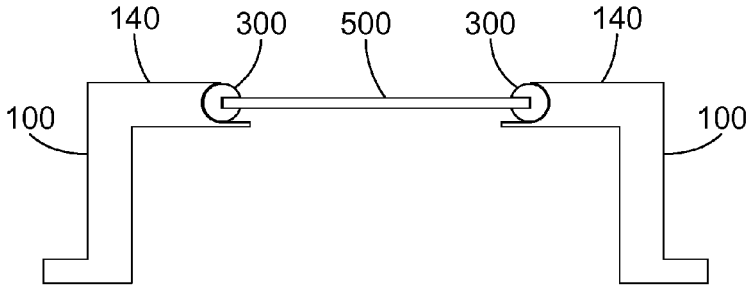
FIG. 10 is a partial cross-sectional view of the valve cover in FIG. 9 taken along the lines 10-10.
Figure 11:
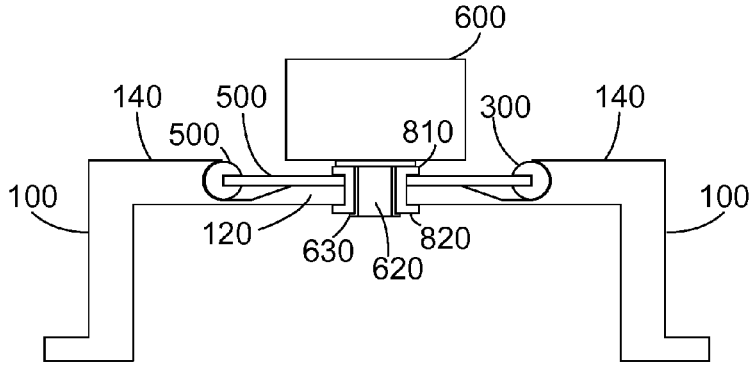
FIG. 11 is a partial cross-sectional view of the valve cover in FIG. 9 taken along the lines 11-11.

Referring to FIGS. 9-11, a valve cover 900 includes the base portion 100 with the display window 500 attached to the base portion via gasket 300 that attaches to the edge of the display window 500 and snaps into the groove 110 shown in FIG. 2. FIG. 10 shows a partial cross-sectional view of the display window 500 that has edges disposed within the groove 310 of gasket 300 (see FIG. 4), with the gasket 300 being pressed into the groove 110 (see FIG. 2). Because the gasket 300 is flexible, the gasket 300 is partially compressed to fit within the groove 110 (FIG. 2), then expands to fill most of the groove as shown in FIG. 10.

FIG. 11 shows a partial cross-sectional view of the valve cover 900 taken along the line 11-11 in FIG. 9. This view shows how the breather 600 is used to help hold the display window 500 in place. Note the internal configuration of the breather is not shown in FIG. 11. The cross member 120 includes hole 130 shown in FIG. 1. The hole 130 is preferably the same size as hole 520 in the display window 500 shown in FIG. 5, and is located so the two holes 130 and 520 align when the display window 500 is snapped into place, as shown in FIGS. 9-11. The cross member 120 includes a raised portion that supports the display window 500 as shown in FIG. 11. A flexible grommet 800 as shown in FIG. 8 is pressed into the hole 520 of the display window 500 and into the hole 130 of cross member 120 until the top lip portion 810 is disposed atop the display window 500 and the bottom lip portion 820 is disposed below the cross member 120. Once the grommet 800 is in place, the breather 600 may be installed by pressing the stem 620 of the breather through a cylindrical interior portion of the grommet 800 until the raised edge 630 extends below the lower lip portion 820 of the grommet, as shown in FIG. 11. The raised edge 630 stops breather 600 from slipping out of the grommet 800, and the upper lip portion 810 and lower lip portion 820 captivate the display window 500 and the cross member 120, thereby providing a secure mechanical coupling between the display window 500 and the cross member 120. Note that cross member 120 need not necessarily span the width of the opening 150 as shown in FIG. 1, but could instead extend from only one of the sides to provide the needed mechanical support for the display window. In fact, the cross member 120 could provide a retaining force on the display window even without using a breather by providing a display window that does not include the hole for the breather, and placing silicone gel or another suitable adhesive to secure the display window 500 to the cross member 120.

Breather 600 helps to assure excessive pressure does not build up in the valve cover that could potentially pop out display window 500. In addition, the mechanical coupling of the display window 500 to the cross member 120 at the breather holds the middle portion of the display window 500 in place, thereby assuring the display window cannot pop out of place when the engine is running.

In one specific implementation, the display window 500 is made of transparent plastic that can survive both the operating temperature of the engine and the exposure to oil on the interior of the valve cover as the engine runs. One suitable transparent plastic for display window 500 is a sheet of Ultem manufactured by Penn Fibre at 2434 Bristol Rd., Bensalem, Pa. 19020. Ultem is fabricated by forming sheets from polyetherimide. Having a transparent display window 500 allows viewing of valve train dynamics and lubrication distribution during engine operation.

In another specific implementation, the display window 500 includes one or more display elements that are capable of providing one or more display effects on display window 500. Examples of suitable display elements include light-emitting diodes (LEDs), optical fibers, electro-luminescent (EL) panels, incandescent bulbs, phosphorous-coated wire, and liquid crystal displays (LCDs). However, the disclosure and claims herein expressly extend to any suitable display element, whether currently known or developed in the future.

One suitable display element is an optical fiber that is fabricated to be transmissive to light in both a longitudinal direction and a transverse direction. Such an optical fiber could be fabricated by starting with a typical circular optical fiber that transmits light only in the longitudinal direction, then milling the side to result in a semi-circular cross section that allows transmission of light in a transverse direction.

Figure 12:
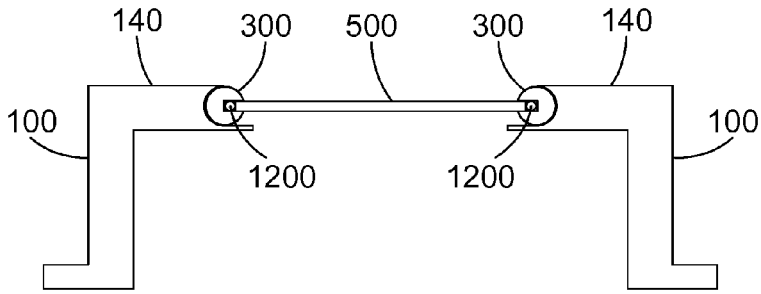
FIG. 12 is a partial cross-sectional view of the valve cover in FIG. 9 when a phosphorous-coated copper wire is used to illuminate the edges of the display window.

Another suitable display element is a phosphorous-coated copper wire, which glows when driven by an appropriate electronic driver circuit. Such a configuration is shown in FIG. 12, where phosphorous-coated copper wire 1200 is disposed between the gasket 300 and the edge of the display window 500. The phosphorous-coated copper wire 1200 preferably runs around the full perimeter of the display window 500. The ends of the phosphorous-coated copper wire 1200 will be coupled to lead wires that exit the flexible gasket 300 and provide an electrical coupling to the lead wires from outside the valve cover. For example, a small hole could be drilled in the valve cover, and a connector could be installed in the hole. The lead wires on the inside of the valve cover could be connected to the interior portion of the connector, and the wires and inside of the connector could then be encased in a protective material such as silicone gel or epoxy. The outside of the connector can then be connected to a display driver that provides the desired electronic signal to drive the phosphorous-coated wire 1200. One suitable supplier of phosphorous-coated copper wire is Live Wire Enterprises, P.O. Box 670081, Flushing, N.Y. 11367. A wire with a diameter of 2.5 mm that provides a clear light is available under the part number C-2.5 mm, and a wire that provides a red light is available under the part number R-2.5 mm. Note the color of the light emanating from the wire itself is typically the same, but a vinyl cover over the wire determines the color of light. Any suitable color could be potentially achieved by varying the color of the vinyl cover. A suitable driver drives two ends of the wire with an alternating voltage to achieve the desired glow in the wire. A suitable inverter that generates 80-90 volts alternating current from a 12 volt direct current power supply (such as a car battery) is available from Live Wire Enterprises as part number AI-1.

Figure 13:
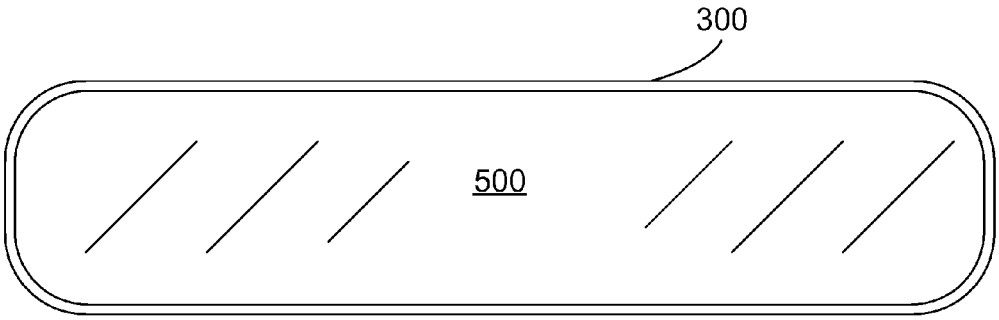
FIG. 13 is a top view of a display window with attached gasket.

Referring to FIG. 13, the display window 500 in FIG. 12 is shown with the flexible gasket 300 attached. In a preferred implementation, a bead of silicone gel is applied within the groove 310 in gasket 300 as shown in FIG. 4, and the outer perimeter of the display window 500 is the pressed into the groove 310, resulting in the display window 500 being surrounded by the gasket 300 as shown in FIG. 13. While the configuration shown in FIG. 5 includes a hole 520 for the breather 600, it is equally within the scope of the disclosure and claims herein to have a display window 500 without the hole, as shown in FIG. 13. For the specific implementation shown in FIG. 12 that includes a phosphorous-coated copper wire 1200, the wire glows but is not directly visible because the wire 1200 is within the gasket 300. Note, however, that the light from the wire will illuminate the display window 500, giving the display window 300 a distinctive lit color that provides an attractive appearance.

Figure 14:
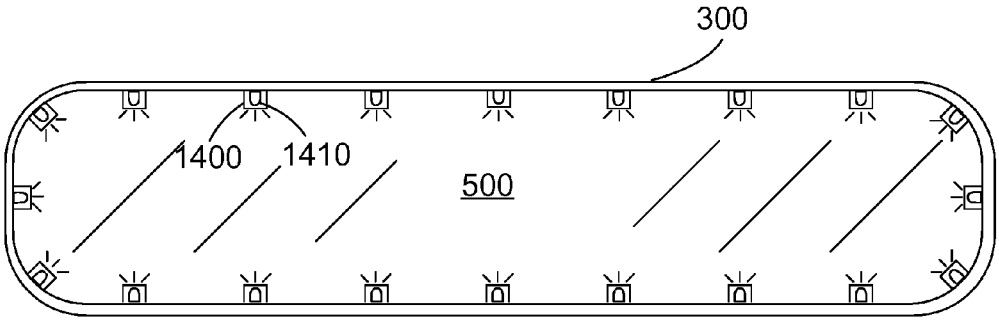
FIG. 14 is a top view of a display window that includes recesses with display elements.

Referring to FIG. 14, in an alternative implementation, the display window 500 may include multiple recesses 1400 for receiving multiple display elements 1410, such as light-emitting diodes (LEDs) or small incandescent bulbs. The recesses 1400 may be formed in the edges of the display window 500 when the display window is fabricated. In the alternative, the recesses 1400 could be performed as an additional step, such as from drilling the edge of the display window. These display elements are connected to a suitable display driver that provides a desired static display or a display that changes over time. The multiple display elements 1410 may be of different colors. In addition, the multiple display elements 1410 may be sequenced to provide a desired display effect, such as flashing lights, chasers, etc. The display elements 1410 are visible in the specific configuration shown in FIG. 14. Note, however, the display elements 1410 could be hidden within the gasket 300, making the display elements themselves not visible but making the light emanating from these display elements visible on the display window 500. The display elements 1410 could be manufactured as part of the gasket 300, or may be separate from the gasket.

Figure 15:
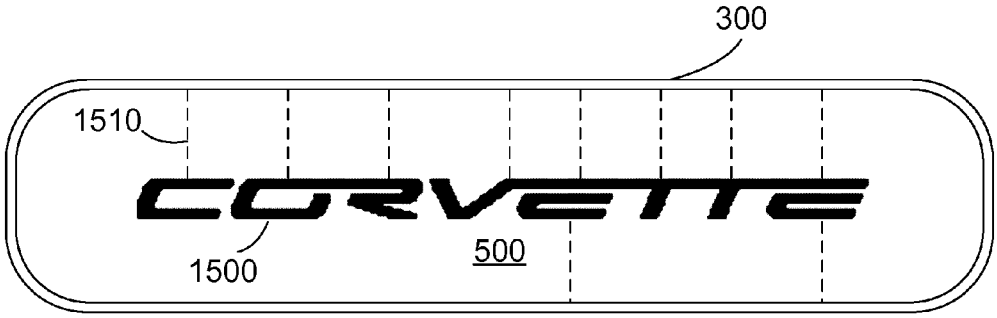
FIG. 15 is a top view of a display window that includes displayed letters.

Yet another alternative for display window 500 is shown in FIG. 15 to include letters defined on the display window 500. In one suitable implementation for the display in FIG. 15, the letters CORVETTE are embossed or etched into the plastic surface. The process of etching preferably leaves white letters on a clear surface. The display window 500 could include an electro-luminescent (EL) panel that backlights the display window 500. In the alternative, optical fibers could be provided as shown at 1510 that provide light of a desired color to the etched letters, thereby illuminating the etched letters. Of course, other types of display elements could be used, such as liquid crystal displays (LCDs). In the case of a liquid crystal display, the letters are formed on the display, with the connecting lines 1510 in FIG. 15 representing conductors that drive each letter in the display.

Note that different types of display elements may be used in combination within the scope of the disclosure and claims herein. For example, the CORVETTE letters could be formed in a liquid crystal display, an electro-luminescent (EL) panel could backlight the CORVETTE letters themselves, while LEDs around the perimeter provide a flashing or chasing effect at the perimeter.

Figure 16:
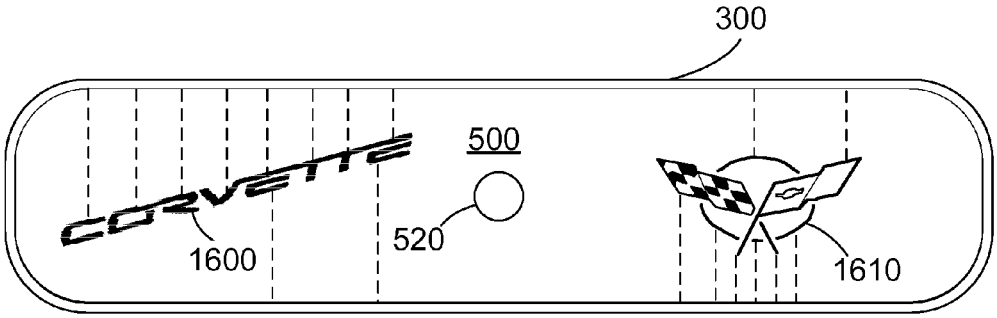
FIG. 16 is a top view of a display window that includes displayed letters and a displayed design.

Referring to FIG. 16, the display window 500 is shown with the hole 520 that allows the attachment of the breather 600. In this configuration, a center portion of the display will be obstructed from view by the breather, but the two sides of the display could include different items, such as the CORVETTE word 1600 on the left side and the flags logo 1610 on the right side of the display window 500, as shown in FIG. 16.

Figure 17:
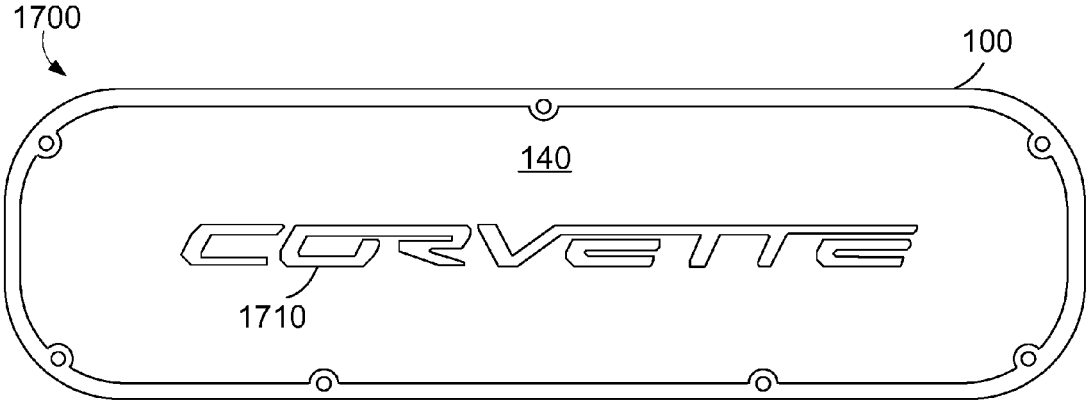
FIG. 17 is a top view of a valve cover that includes letters cut in the top portion with a display panel disposed underneath the letters inside the valve cover.

Yet another implementation eliminates the need for the gasket 300 to hold the display window in place. Referring to FIG. 17, a valve cover 1700 is shown that includes a portion 1710 that is cut out from the top surface of the valve cover. In this example, the letters for CORVETTE extend clear through the top surface. A display window may now be mounted on the inside of the valve cover the be underneath the letters to provide a view into the valve cover. For example, small holes could be drilled and tapped in the inside top portion of the valve cover, and a suitable display window can then be attached to the inside top portion of the valve cover using suitable screws that engage the tapped holes. A bead of silicone gel is preferably applied before securing the display window in place in the valve cover. Note the display window may include any suitable display elements as discussed above. The result is a valve cover that includes one or more openings in the top of the base portion with a display window attached to the base portion to provide an electronic display in the one or more openings.

Note the display window disclosed herein may include multiple layers. For example, if an electro-luminescent (EL) panel cannot survive in the environment that includes direct contact with engine oil, the EL panel could be encapsulated between layers of other material, such as Ultem, that protects the EL panel from being in contact with the engine oil. In addition, multiple types of display elements may be provided in different layers of the display window.

Figure 18:
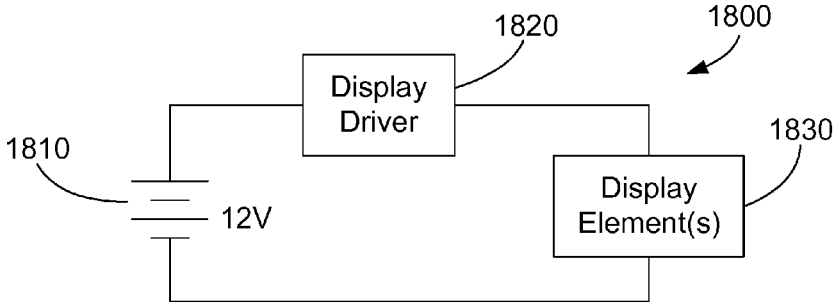
FIG. 18 is a block diagram view of a circuit for driving display elements in the display window.

Referring to FIG. 18, a circuit 1800 is shown that includes a DC voltage source 1810, a display driver 1820, and one or more display elements 1830. The DC voltage source 1810 is preferably the 12 volt direct current voltage provided by the vehicle battery. The display driver 1820 is powered by the DC voltage source 1810 and provides one or more appropriate display signals to the display element(s) 1830. If the display element 1830 is a phosphorous-coated copper wire, the display driver 1820 will output an alternating current signal of the appropriate voltage and frequency that causes the wire to output light. If the display element 1830 is an optical fiber, the display driver 1820 may include drive electronics and a light source such as an LED or laser diode coupled optically to the end of the optical fiber. If the display element 1830 is a liquid crystal display (LCD), the display driver provides suitable signals to drive the desired display on the LCD, as is known in the art. Of course, combinations of display elements may also be used, which will require a display driver that can drive multiple different display elements or multiple display drivers working in concert to provide a desired effect on the display window. The display driver 1820 may provide a static display that does not change over time, or a dynamic display that changes over time (such as flashing, chasing, etc.)

Figure 19:
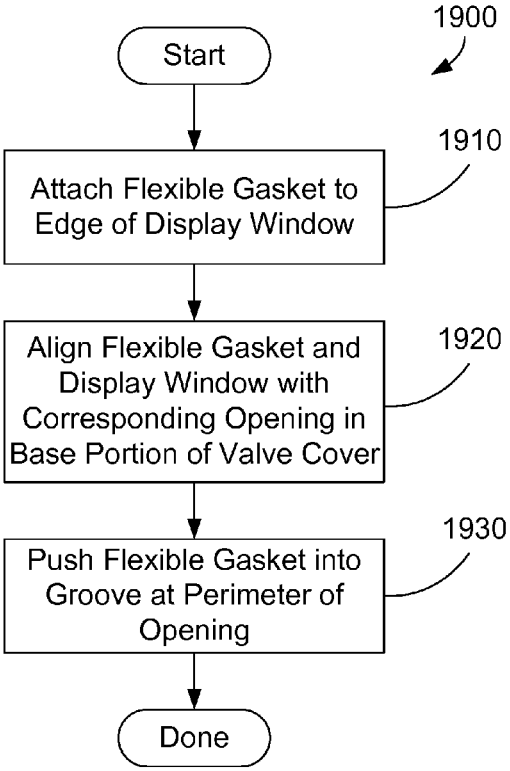
FIG. 19 is a flow diagram of a method for assembling a display window to a base portion of a valve cover using a flexible gasket.
Figure 20:
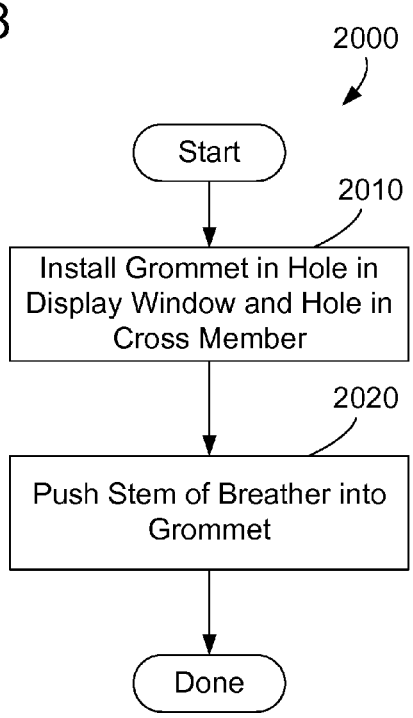
FIG. 20 is a flow diagram of a method for installing a breather into the holes in the display window and cross member.

Referring to FIG. 19, a method 1900 for assembling the valve cover 900 in FIG. 9 begins by attaching a flexible gasket to an edge of the display window (step 1910), preferably after applying a bead of silicone gel to the groove in the gasket, resulting in the display window and gasket as shown in FIG. 13. Next, the display window with the attached flexible gasket is aligned with a corresponding opening in a base portion of the valve cover (step 1920), and the flexible gasket is pushed into the groove extending along an interior perimeter of the opening in the valve cover (step 1930), thereby snapping the gasket into the groove and coupling the display window to the base portion. If the display window 500 does not have a hole for a breather, the installation of the display window is complete.

If the display window includes a hole for a breather, the additional steps in method 2000 need to be performed. First, a flexible grommet is installed in a hole in the display window and in a corresponding hole in a cross member of the base portion (step 2010) so a top lip portion of the grommet is above the display window, a bottom lip portion of the grommet is below the cross member, and a reduced diameter portion between the top lip portion and the bottom lip portion receives an edge of the display window and an edge of the cross member, with the flexible grommet defining a substantially cylindrical interior portion. A breather is then installed by pushing a stem portion to extend through the substantially cylindrical interior portion of the flexible grommet (step 2020), thereby captivating the display window and cross member within the reduced diameter portion of the flexible grommet between the upper lip portion and lower lip portion.

The valve cover disclosed and claimed herein is not only attractive, but is functional as well because it can withstand the operating environment of the engine, including both temperature and exposure to petroleum-based products. A clear display window may be provided to allow visual inspection of the valve train operation and lubrication as the engine runs. In addition, one or more display elements may be incorporated into the display window or near the display window to provide a desired static display or a desired display that varies over time. The result is a valve cover that is very durable, yet provides a specialized appearance when looking at the valve cover.

One skilled in the art will appreciate that many variations are possible within the scope of the claims. Thus, while the disclosure is particularly shown and described above, it will be understood by those skilled in the art that these and other changes in form and details may be made therein without departing from the spirit and scope of the claims.

What is claimed is:

1. A valve cover for an internal combustion engine, the valve cover comprising:

a base portion that covers a plurality of valves in the internal combustion engine;

an opening in a top of the base portion;

a groove extending along an interior perimeter of the opening;

a display window that allows viewing at least one of the plurality of valves; and a flexible gasket that fits onto edges of the display window and into the groove, thereby coupling the display window to the base portion;

a flexible grommet disposed in a hole in the display window and in a corresponding hole in a cross member of the base portion, the flexible grommet including a top lip portion that is above the display window, a bottom lip portion that is below the cross member, and a reduced diameter portion between the top lip portion and the bottom lip portion that receives an edge of the display window and an edge of the cross member, the flexible grommet defining a substantially cylindrical interior portion; and a breather having a stem portion that extends through the substantially cylindrical interior portion, thereby captivating the display window and cross member within the reduced diameter portion of the flexible grommet between the top lip portion and the bottom lip portion.

2. The valve cover of claim 1 wherein the display window is substantially transparent.

3. The valve cover of claim 1 wherein the display window comprises at least one display element.

4. The valve cover of claim 3 wherein the at least one display element is selected from the group: light-emitting diodes, optical fibers, electro-luminescent panels, incandescent bulbs, phosphorous-coated wire, and liquid crystal displays.

5. The valve cover of claim 3 further comprising a display driver electrically coupled to the at least one display element, the display driver driving the at least one display element to provide a static display.

6. The valve cover of claim 3 further comprising a display driver electrically coupled to the at least one display element, the display driver driving the at least one display element to provide a display that changes over time.

7. The valve cover of claim 1 wherein the base portion is metal.

8. A method for assembling a valve cover that includes a display window, the method comprising the steps of:

attaching a flexible gasket to an edge of a display window;

aligning the display window with attached flexible gasket with a corresponding opening in a base portion of the valve cover that covers a plurality of valves in an internal combustion engine;

pushing the flexible gasket into a groove extending along an interior perimeter of the opening in the valve cover, thereby coupling the display window to the base portion, the display window allowing viewing at least one of the plurality of valves;

installing a flexible grommet in a hole in the display window and in a corresponding hole in a cross member of the base portion, the flexible grommet including a top lip portion that is above the display window, a bottom lip portion that is below the cross member, and a reduced diameter portion between the top lip portion and the bottom lip portion that receives an edge of the display window and an edge of the cross member, the flexible grommet defining a substantially cylindrical interior portion; and installing a breather having a stem portion that extends through the substantially cylindrical interior portion, thereby captivating the display window and cross member within the reduced diameter portion of the flexible grommet between the top lip portion and the bottom lip portion of the flexible grommet.

9. A valve cover for an internal combustion engine, the valve cover comprising:

a metal base portion;

a substantially rectangular opening in a top of the metal base portion, the substantially rectangular opening having rounded corners and a cross-member with a hole at substantially the center of the top;

a substantially semi-circular groove extending along an interior perimeter of the opening that has a bottom edge that extends further into the opening than an upper edge;

a substantially transparent display window having a shape similar to the substantially rectangular opening and a size smaller than the substantially rectangular opening, the display window including a hole that aligns with the hole in the cross-member when the display window is attached to the metal base portion;

a flexible gasket that fits onto edges of the display window and into the groove, thereby coupling the display window to the metal base portion;

a flexible grommet disposed in the hole in the display window and in the hole in the cross member, the flexible grommet including a top lip portion that is above the display window, a bottom lip portion that is below the cross member, and a reduced diameter portion between the top lip portion and the bottom lip portion that receives an edge of the hole in the display window and an edge of the hole in the cross member, the flexible grommet defining a substantially cylindrical interior portion; and a breather having a stem portion that extends through the substantially cylindrical interior portion, thereby captivating the display window and cross member between the top lip portion and bottom lip portion of the flexible grommet.

10. The valve cover of claim 9 wherein the display window comprises at least one display element.

11. The valve cover of claim 10 wherein the at least one display element is selected from the group: light-emitting diodes, optical fibers, electro-luminescent panels, incandescent bulbs, phosphorous-coated wire, and liquid crystal displays.

12. The valve cover of claim 10 further comprising a display driver electrically coupled to the at least one display element, the display driver driving the at least one display element to provide a static display.

13. The valve cover of claim 10 further comprising a display driver electrically coupled to the at least one display element, the display driver driving the at least one display element to provide a display that changes over time.

* * * * *